US006238038B1

(12) United States Patent
Gilham et al.

(10) Patent No.: US 6,238,038 B1
(45) Date of Patent: May 29, 2001

(54) SECURE DIGITAL POSTAGE PRINT MODULE

(75) Inventors: Dennis Gilham, Paris; Thierry Le Jaoudour, Verrieres le Buisson; Arsène Paul, Le Pre Saint Gervais, all of (FR)

(73) Assignee: Neopost Industrie, Bagneux (FR)

( * ) Notice: Subject to any disclaimer, the term of this patent is extended or adjusted under 35 U.S.C. 154(b) by 0 days.

(21) Appl. No.: 09/222,697

(22) Filed: Dec. 29, 1998

(30) Foreign Application Priority Data

Dec. 30, 1997 (FR) ..... 97 16662

(51) Int. Cl.[7] ..... M41J 20/40
(52) U.S. Cl. ..... 347/49; 347/50
(58) Field of Search ..... 347/48, 50; 395/185; 400/691; 346/143

(56) References Cited

U.S. PATENT DOCUMENTS

| | | | | |
|---|---|---|---|---|
| 4,831,555 | | 5/1989 | Sansone et al. | 364/519 |
| 5,359,357 | * | 10/1994 | Takagi et al. | 347/49 |
| 5,359,359 | * | 10/1994 | Dietrich et al. | 346/143 |
| 5,519,422 | * | 5/1996 | Thoman et al. | 347/49 |
| 5,539,436 | * | 7/1996 | Wilson et al. | 347/49 |
| 5,684,949 | | 11/1997 | Naclerio | 395/186 |

FOREIGN PATENT DOCUMENTS

| | | |
|---|---|---|
| 0 393 896 A2 | 10/1990 | (EP) . |
| 0 522 809 A2 | 1/1993 | (EP) . |
| 0 717 374 A2 | 6/1996 | (EP) . |

* cited by examiner

*Primary Examiner*—N. Le
*Assistant Examiner*—Anh T. N. Vo
(74) *Attorney, Agent, or Firm*—Sughrue, Mion, Zinn, Macpeak & Seas, PLLC

(57) ABSTRACT

A secure digital print module designed to be mounted on the base of a postage meter for the purpose of printing a postage imprint, the print module containing at least one standard ink cartridge for ink-jet printing, which cartridge is provided with electrical contacts, said print module having a rigid cartridge support for receiving said at least one standard ink cartridge, a protective casing entirely encasing said at least one standard ink cartridge and fixed indissociably to said rigid cartridge support, and a flexible link support provided with electronic integrated circuits and with a plurality of series of electrical contacts for connecting the integrated circuits respectively to the standard ink cartridge and to said postage meter base so as to enable said standard ink cartridge to be controlled directly from the base of the postage meter. Preferably, the cartridge support can receive two standard ink cartridges.

8 Claims, 5 Drawing Sheets

SECURE DIGITAL POSTAGE PRINT MODULE

FIELD OF THE INVENTION

The present invention relates to the field of mail handling, and in particular to the field of ink-jet digital print assemblies for printing a postage imprint.

PRIOR ART

In a conventional postage metering or franking system (i.e. in a conventional postage meter) comprising a base and an associated print head, the devices for keeping metering accounts (in particular up/down counters) and for printing postage imprints (e.g. a rotary print drum) are placed in a secure enclosure disposed at the print head and sealed in tamper-proof manner so that access is denied to any unauthorized person, i.e. any person other than an authorized employee of the postal authorities or of the manufacturer. Therefore, whenever problems arise with the print device (e.g. the print wheels jam or the print plates are clogged on the rotary drum), then, since the user is denied access to the print head, it is necessary to call out an authorized person from outside the firm to repair the print head, and then to return it to the postal authorities for it to be validated again. Unfortunately, as a result, the postage meter remains unusable for a length of time that can, in some circumstances, be quite lengthy.

It is known, in particular from the Applicants' European Patent Applications BP 0 775 986, EP 0 775 987, and EP 0 775 988, that it is possible to provide a modular postage meter in which the metering accounts device is separated from the postage print device. The accounts device is an electronic module connected to a conventional computer, and the print device is a general-purpose printer.

OBJECT AND DEFINITION OF THE INVENTION

An object of the present invention is to provide a postage meter that does not suffer from the above-mentioned drawbacks, and in particular that remains of conventional architecture while mitigating the problems involved in detaching the print head. In addition, this novel type of meter should be reliable and also be lower in cost than conventional meters.

These objects are achieved by a postage meter in which the accounts device is separate from the print device, the accounts device being integrated in the base of the postage meter, and the print device being constituted by a disposable digital print module and being connected to the base of the postage meter via a secure-type link.

Thus, the conventional structure of the postage meter is retained, while, by making provision for the print module to be disposable, the invention offers a major advantage of avoiding all of the problems of maintenance related to the print elements. In addition, it is still possible to have one or more print modules in reserve so as to avoid running out and being obliged to interrupt franking. Credit can be recharged in conventional manner via an IC card by using the Applicant's "CREDIPAC" system, or remotely via the telephone network.

The present invention also provides the disposable print module for this postage meter, which module is designed to be mounted on the base of a postage meter for the purpose of printing a postage imprint, and contains at least one standard ink cartridge for ink-jet printing, which cartridge is provided with electrical contacts, said print module comprising a rigid cartridge support for receiving said at least one standard ink cartridge, a protective casing entirely encasing said at least one standard ink cartridge and fixed indissociably to said rigid cartridge support, and a flexible link support provided with electronic integrated circuits and with a plurality of series of electrical contacts for connecting the integrated circuits respectively to said at least one standard ink cartridge and to said postage meter base so as to enable said at least one standard ink cartridge to be controlled directly from the base of the postage meter.

Thus, the print module can be a consumable (disposable) product of reasonable cost while being secure from any attempts at using it fraudulently.

Preferably, the cartridge support can receive two standard ink cartridges. Advantageously, the standard ink cartridge is glued to the cartridge support, and the flexible link support is glued both to the protective casing and to the cartridge support. Similarly, the protective casing is fixed to the cartridge support by gluing or else optionally by welding.

Advantageously, the cartridge support and the protective casing are each provided with at least one slot to enable the flexible link support to pass through.

In order to prevent it physically from being mounted in a standard printer, the print module of the invention is provided with a keying mechanism.

In a preferred embodiment, the electronic integrated circuits include a microprocessor circuit and a memory circuit containing at least one determined identity number specific to the print module in question. These electronic integrated circuits further include control circuits for controlling each of the ink jet nozzles of said at least one standard ink cartridge.

In another embodiment, the memory circuit is replaced with an identity label bearing the determined identity number, which label is embedded in the protective casing and is accessible in contact-free manner by means of a transponder read circuit disposed in the base of the postage meter.

BRIEF DESCRIPTION OF THE DRAWINGS

Other characteristics and advantages of the present invention appear more clearly from the following description given by way of non-limiting example and with reference to the accompanying drawings, in which.

DETAILED DESCRIPTION OF A PREFERRED EMBODIMENT

Figure 8:
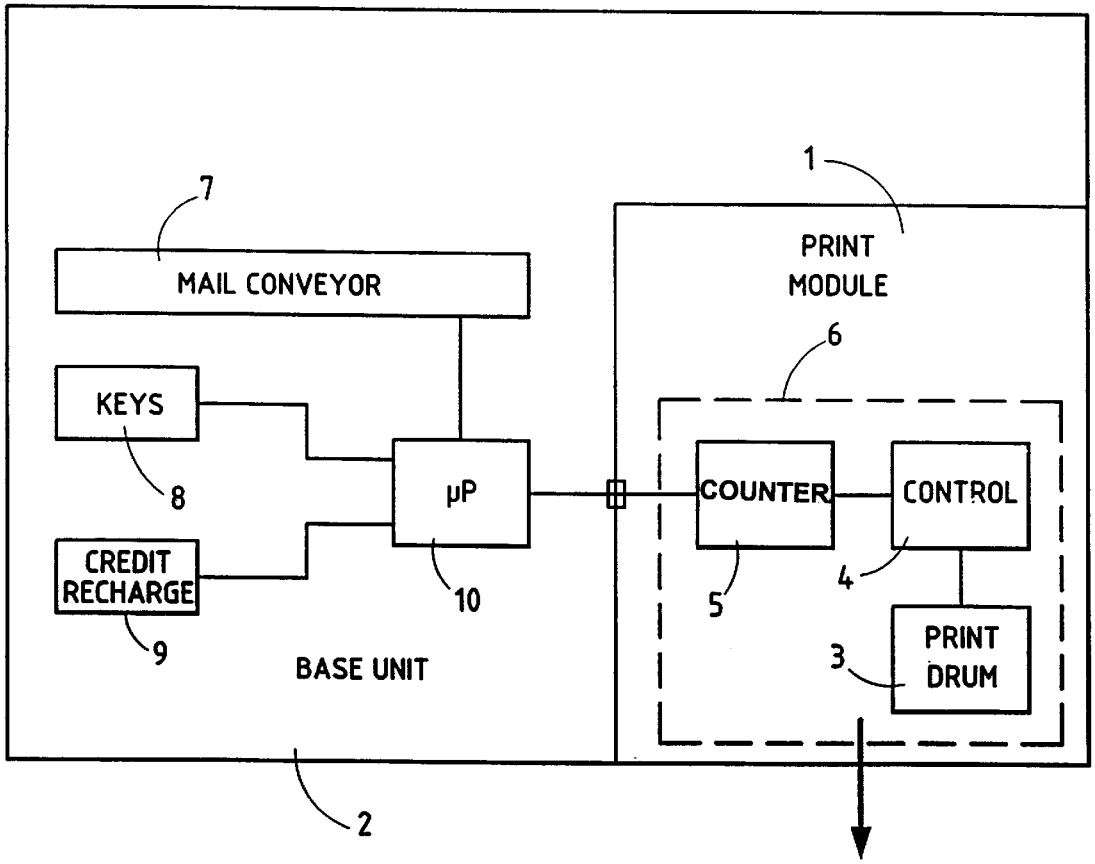
FIG.8 (PRIOR ART)
FIG. 8 shows the architecture of a conventional postage meter.

A conventional postage meter or "franking machine" is shown in FIG. 8. It includes a print head 1 which can be detached from a base 2 of the postage meter. Conventionally, the print head comprises a print drum 3 actuated by control means 4, and up/down counters forming a metering accounts device 5. The print drum, its control means, and the counters are disposed in an enclosure 6 that is closed and sealed in tamper-proof manner to deny access to any unauthorized person. Thus, the user of the postage meter cannot access the print elements (print wheels or plates), even merely to perform preventive maintenance or cleaning. The base of the postage meter conventionally comprises a mail item conveyor path 7 (conveyor rollers, drive motors, and associated control circuits), and input/output means for the user: a keyboard 8 or the credit recharging system 9 of the type proposed by the Applicant ("CREDIPAC") connected to processing means 10. The print head 1 is linked to the base of the postage meter 2 via a conventional non-secure link. However, the recharging procedure, in particular for remote recharging, is enciphered.

Figure 1:
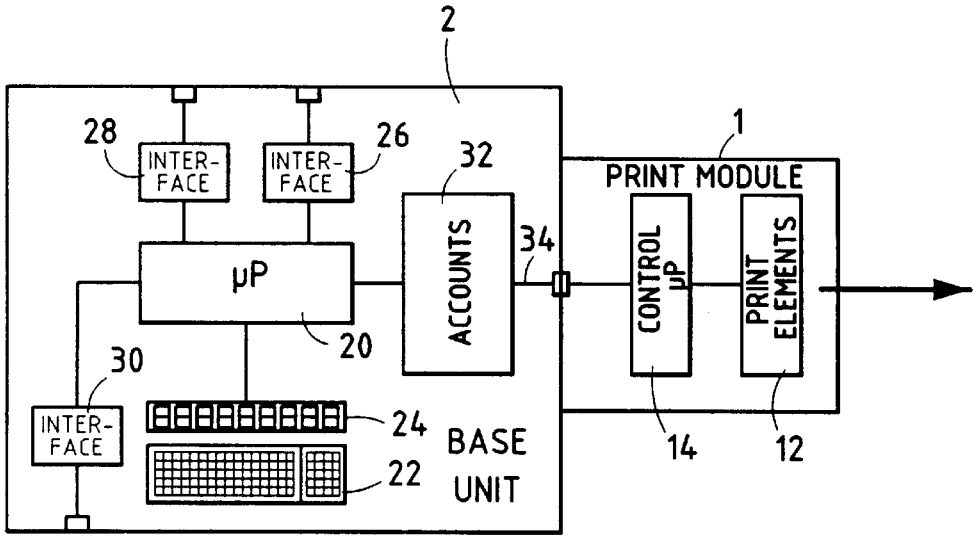
FIG. 1 shows the novel architecture of a postage meter of the invention.

The present invention proposes novel postage meter architecture which is similar to the conventional architecture in that the conveyor means and the print means likewise form respective structural units but which, through its novel design, does not suffer from the limitations of the conventional architecture. FIG. 1 diagrammatically shows this novel architecture. FIG. 1 shows the print means 1 which are made up of print elements 12 which, in the context of the present invention, are of the digital type and preferably of the ink-jet type, and control means 14 for controlling said elements, which means are advantageously microprocessor means. The base 2 of the postage meter is organized around its processing means 20, which are advantageously microprocessor means, with a keyboard 22, a display screen 24, and various interfaces, e.g. an interface 26 for linking to a "CREDIPAC" type credit recharger module, an interface 28 for linking to a telephone network, and an interface 30 for reading IC cards. The base further comprises a module 32 that is not accessible to the user and that contains the metering accounts device with its up/down counters, and a graphics memory containing all of the images required to print the postage imprint. The link between the base 2 of the postage meter and the print means 1 is provided by means of a secure-type link 34, e.g. conventionally an enciphered link (enciphered by means of an enciphering algorithm of the RSA type), or in the clear with a signature (signed by means of a standard signing algorithm of the DSA type).

Figure 2A:
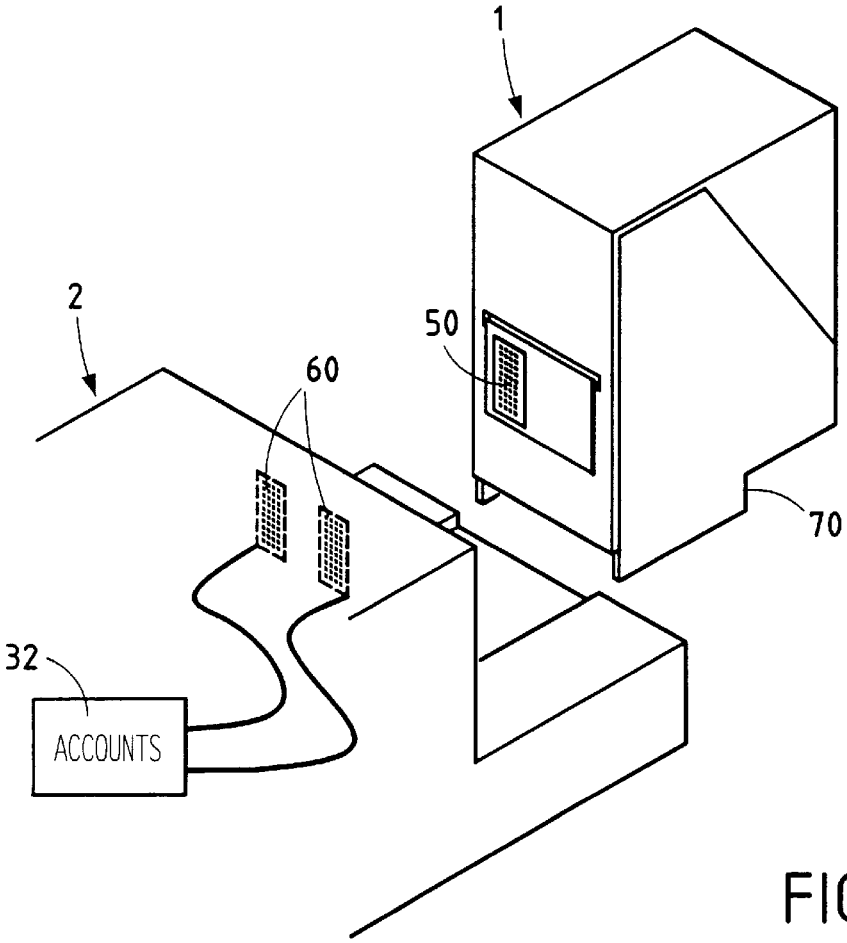
FIG. 2*a*. show a first embodiment of a secure print module of the invention, designed to be mounted on a postage meter base.

FIG. 2 shows a digital print module designed to be mounted on the postage meter base 2, and for printing a postage imprint on a mail item. In the example shown, the module 1, which may also be referred to as the "print head" in the remainder of this description, contains a standard ink cartridge for ink-jet printing, e.g. a cartridge of the HP 51645A type sold by Hewlett Packard. Externally, the module is further provided with a series of external electrical contacts 50 connected to the control means (referenced 14 in FIG. 1) and designed to co-operate with at least one corresponding series of contacts 60 on the base of the postage meter, the contacts on the base also being connected to the module 32 of the postage meter, which module contains, in particular, the accounts device with its up/down counters and its graphics memory. The print head forms a disposable module which is provided with keying means for physically preventing the module from being mounted in a standard general-purpose printer.

Figure 2B:
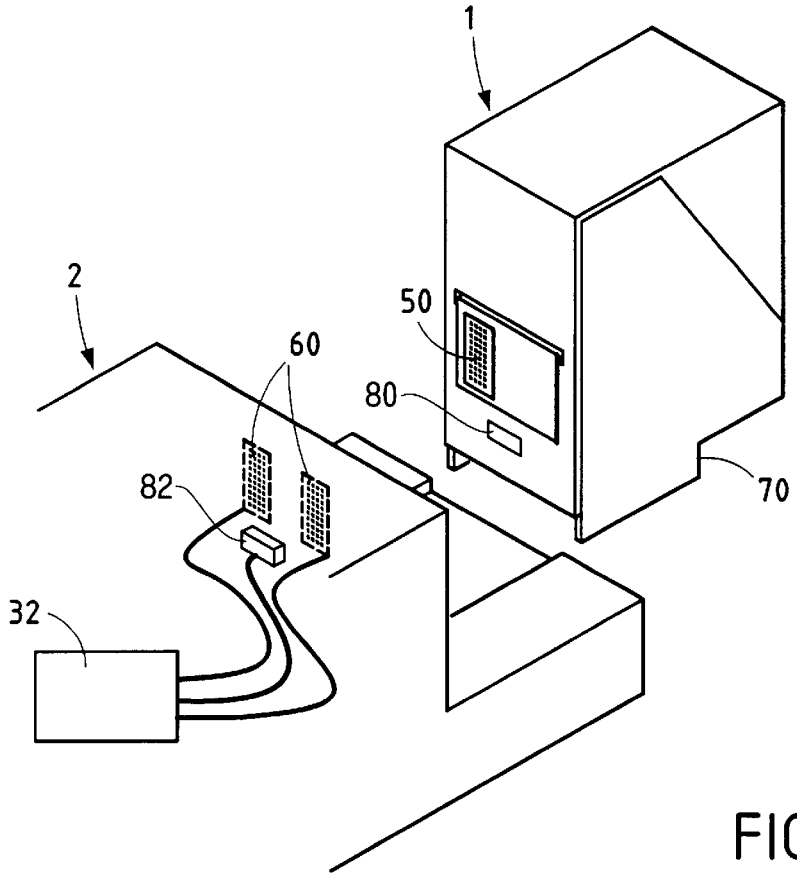
FIG. 2*b* shows another embodiment where the identity label of the print head is embedded in the protective casing.
Figure 4:
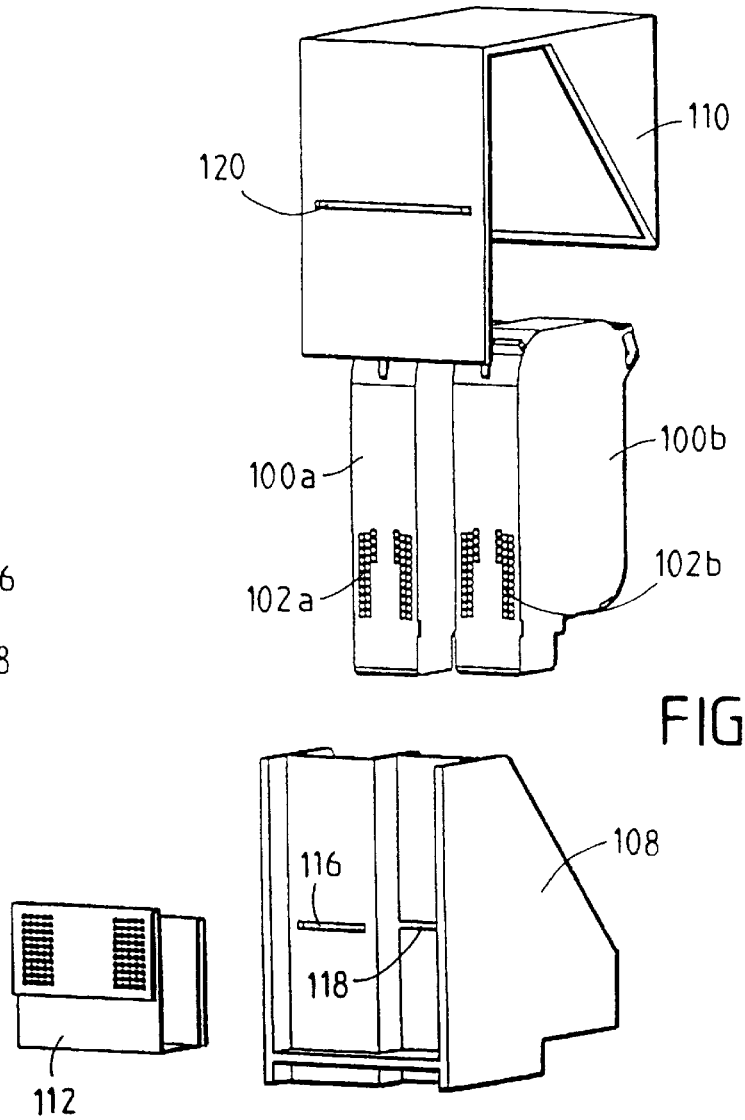
FIG. 4 is an exploded view of the FIG. 3 print module, showing the various components thereof.
Figure 3:
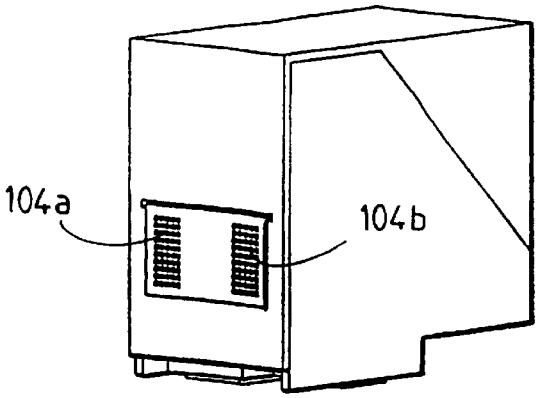
FIG. 3 shows a second embodiment of a secure print module of the invention.

FIG. 3 and FIG. 4 (which is an exploded view of FIG. 3) show a second embodiment of a secure disposable print module of the invention. In this embodiment, the module is provided with two standard ink cartridges 100*a* and 100*b*, and it is therefore provided with two series of external electrical contacts 104*a* and 104*b* for providing the link with the base of the postage meter. As shown in FIG. 2, the base is naturally suitable for receiving various different versions of the module (e.g. having one or two series of contacts). The module is provided with a rigid cartridge support 108 for receiving the standard ink cartridges, and for enabling them to be positioned reliably, a protective casing 110 entirely enclosing the standard ink cartridges and fixed indissociably to the rigid cartridge support to prevent the cartridges from being removed individually, and a flexible link support 112 provided with electronic integrated circuits 114 and four series of electrical contacts (two for the links with the electrical contacts 102*a*, 102*b* of each cartridge) including two external series 104*a*, 104*b* for providing the electrical link between the cartridges and the base of the postage meter. When the postage meter is in operation, in order to enable the link to extend through the module from the electrical contacts on the cartridges to the electrical contacts on the base and vice versa, the support 108 and the casing 110 are provided with respective slots (each of them being provided with at least one slot) for enabling the flexible link support 112 to pass through. Thus, for example, the support is provided with two slots 116 and 118, each of which is disposed substantially level with the electrical contacts of a determined cartridge, and the casing is provided with a single slot 120 positioned substantially at the same level.

Advantageously, adhesive is used to fix the cartridges to the support, and to fix the flexible support (advantageously made of an elastomer material) to the rigid support and to the casing. Likewise, the casing is preferably fixed to the support by adhesive. However, if the materials of the support and of the casing are suitable, welding may be considered. The adhesive prevents any attempt to access the flexible support and the integrated circuits that it contains because such access would only destroy the circuits and inevitably damage the print head.

Figure 5:
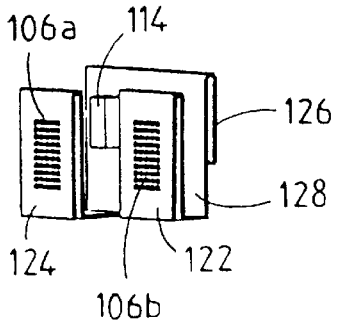
FIG. 5 is a perspective view of a flexible link support for the module shown in FIGS. 3 and 4.

FIG. 5 shows the flexible support 112 in more detail. The flexible support is provided with four series of electrical contacts. Two series of internal contacts 106*a*, 106*b* are mounted independently on respective ones of two flexible tabs 122, 124, and they enable connection to be made with the contacts on the cartridges 102*a*, 102*b* by passing through the slots in the support 116, 118, the two other series of external contacts 104*a*, 104*b* being mounted on a common flexible tab 110 which, by passing through the slot in the casing 120, enables connection to be made with the contacts on the base (shown in FIG. 2 only). Between the tabs, a central portion 128 of the flexible support receives the electronic integrated circuits 114 connected via the various series of contacts to the standard ink cartridges and to the postage meter base in order to enable the cartridges to be controlled directly from the base of the postage meter.

Figure 6B:
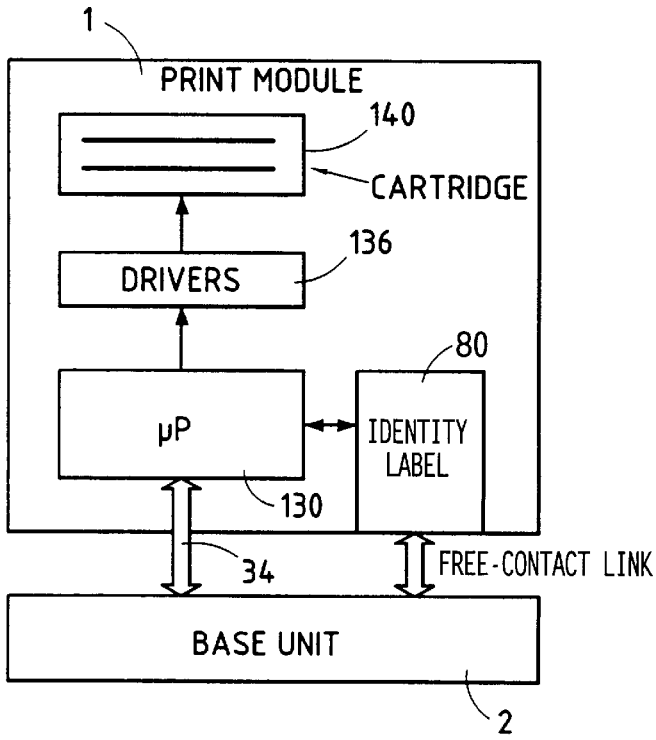
FIGS. 6*a* and 6*b* are block diagrams showing the electronic circuits mounted on the flexible link support.
Figure 6A:
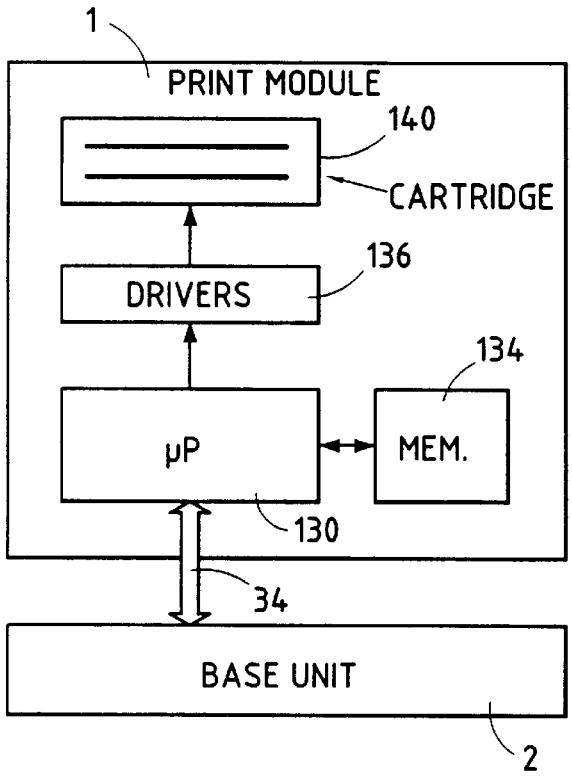

The component parts of the various electronic integrated circuits mounted on the flexible support and forming the means 14 for controlling the print elements are shown in FIG. 6. The circuits include a microprocessor circuit 130 and a memory circuit 134 containing at least one determined identity number specific to the print module in question. In addition, power control circuits 136 of the driver type are provided to actuate each of the ink-jet nozzles 140 of the standard ink cartridges directly. The identity number is advantageously a unique serial number suitable for constituting a computing parameter in generating a particular code by means of a specific algorithm.

Figure 7:
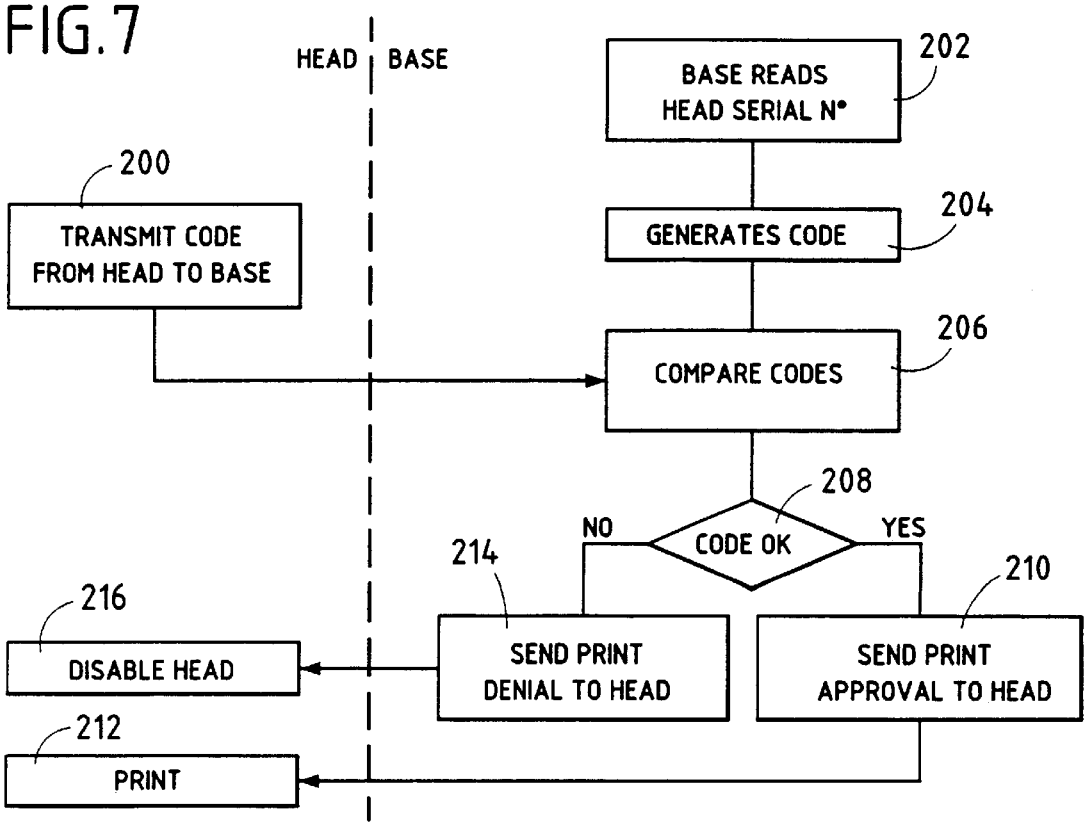
FIG. 7 is a flow chart showing the means implemented for enabling the print module to be recognized by the postage meter base.

FIG. 7 shows the various operations performed at the print module (head) and at the base of the postage meter in order to guarantee that printing is secure. Firstly, in a step 200, the particular code generated in the print head on the basis of the serial number of said head and of the specific algorithm is transmitted via one of the electrical contacts 104*a*, 104*b*. In parallel, in a step 202, and via the same contacts, the base of the postage meter reads the serial number of the print head, and, in a step 204, a corresponding code is generated by applying the specific algorithm. In a step 206, the code as received from the print head is compared with the code as generated in the base, and when the codes match (when the answer to the test of the step 208 is "yes"), an approval is transmitted to the print head in a step 210 so that the print head then, in the following step 212, prints the postage imprint on the basis of various information data transmitted via the electrical contacts. Otherwise (answer to the test in step 208 is "no"), a denial is transmitted to the print head 214, and it can disable the head irreversibly, e.g. after a predetermined number of failed attempts (final step 216).

With this system of cartridge recognition, it is not possible to use standard cartridges for fraudulent purposes. Naturally, the invention is not limited to the above-described embodiments, and, for example, the serial number may be read by means of a contact-free read method, instead of being read via the external contacts of the print head from a memory in the print head. For this purpose, the print head may contain an identity label 80 bearing the serial number and embedded in the body of the protective casing, which label responds to interrogation by a conventional transponder circuit 82 disposed in the base of the postage meter, as shown in FIGS. 2*b* and 6*b*. In addition, it should also be noted that, in order to obtain good printing quality, the ink cartridges should be adjusted at the manufacturing stage both in the scanning direction and in a direction perpendicular thereto. In this way, the user of the postage meter can fit the print head without any adjustment being necessary.

What is claimed is:

1. A secure and disposable digital print module mountable on a base of a postage meter for the purpose of printing a postage imprint, the print module containing at least one standard ink cartridge for ink-jet printing, which cartridge is provided with electrical contacts, said print module comprising a rigid cartridge support for receiving said at least one standard ink cartridge, a protective casing entirely encasing said at least one standard ink cartridge and fixed inseparably to said rigid cartridge support, and a flexible link support provided with electronic integrated circuits and with a plurality of series of electrical contacts for connecting the integrated circuits respectively to said at least one standard ink cartridge and to said postage meter base so as to enable said at least one standard ink cartridge to be controlled directly from the base of the postage meter.

2. A print module according to claim 1, wherein the cartridge support receives two standard ink cartridges.

3. A print module according to claim 2, wherein said at least one standard ink cartridge is glued to the cartridge support, and wherein the flexible link support is glued both to the protective casing and to the cartridge support.

4. A print module according to claim 1, wherein the protective casing is fixed to the cartridge support by gluing or else optionally by welding.

5. A print module according to claim 1, wherein the cartridge support and the protective casing are each provided with at least one slot to enable the flexible link support to pass through.

6. A print module according to claim 1, wherein said electronic integrated circuits include a microprocessor circuit and a memory circuit containing at least one predetermined identity number specific to the print module in question.

7. A print module according to claim 6, wherein said electronic integrated circuits further include control circuits for controlling ink jet nozzles of said at least one standard ink cartridge.

8. A secure and disposable digital print module mountable on a base of a postage meter for the purpose of printing a postage imprint, the print module containing at least one standard ink cartridge for ink-jet printing, which cartridge is provided with electrical contacts, said print module comprising a rigid cartridge support for receiving said at least one standard ink cartridge, a protective casing entirely encasing said at least one standard ink cartridge and fixed inseparably to said rigid cartridge support and a flexible link support provided with electronic integrated circuits and with a plurality of series of electrical contacts for connecting the integrated circuits respectively to said at least one standard ink cartridge and to said postage meter base so as to enable said at least one standard ink cartridge to be controlled directly from the base of the postage meter, wherein said electronic integrated circuits include a microprocessor circuit, control circuit for controlling ink jet nozzles of said at least one standard ink cartridge, and an identity label bearing at least one predetermined identity number specific to the print module, said identity label being embedded in the protective casing and being accessible in a contact-free manner by means of a transponder read circuit disposed in the base of the postage meter.

* * * * *